US009447602B1

(12) United States Patent
Arias

(10) Patent No.: US 9,447,602 B1
(45) Date of Patent: Sep. 20, 2016

(54) MULTIPURPOSE MODULAR SCREENING DEVICE

(71) Applicant: Eduardo Arias, Miami Lakes, FL (US)

(72) Inventor: Eduardo Arias, Miami Lakes, FL (US)

( * ) Notice: Subject to any disclaimer, the term of this patent is extended or adjusted under 35 U.S.C. 154(b) by 0 days.

(21) Appl. No.: 14/810,674

(22) Filed: Jul. 28, 2015

(51) Int. Cl.
*E04H 15/48* (2006.01)
*A47G 5/00* (2006.01)
*E04H 15/58* (2006.01)

(52) U.S. Cl.
CPC ..... *E04H 15/48* (2013.01); *A47G 5/00* (2013.01); *E04H 15/58* (2013.01)

(58) Field of Classification Search
CPC ..... E04H 15/32; E04H 15/18; E04H 15/04; E04H 15/44; E04H 15/58; E04H 15/03; Y10T 403/44; E04B 1/02
USPC ..... 135/87, 97, 143, 156, 157, 117, 119, 135/120.3, 905, 901; 160/135, 351; 52/71, 52/63, 83, 238.1, 239; 403/171–173, 403/217–219
See application file for complete search history.

(56) References Cited

U.S. PATENT DOCUMENTS 2,540,411 A 2/1951 Wright
3,913,598 A * 10/1975 Glutting, Jr. ..... E04H 1/1205 135/117
4,047,337 A * 9/1977 Bergstrom ..... A47G 5/00 16/225
4,685,484 A * 8/1987 Moneta ..... E04H 15/003 135/117
4,798,019 A * 1/1989 Sury ..... A01M 31/025 135/901
4,974,265 A 12/1990 Maggio
5,172,525 A 12/1992 Cook
5,430,980 A 7/1995 Ferrier
5,595,230 A * 1/1997 Guerra ..... E01F 7/00 135/900
5,678,706 A * 10/1997 Husak ..... A47B 47/005 211/189
6,092,792 A * 7/2000 Camara ..... E04H 15/003 135/87
6,145,528 A * 11/2000 Egnew ..... E04H 12/2215 135/114
6,206,079 B1 * 3/2001 Selgrad ..... A47G 5/00 160/135
6,840,254 B1 1/2005 Windham
6,892,744 B2 5/2005 Feldpausch et al.
9,107,387 B1 * 8/2015 Pavlik ..... A01K 1/034
2004/0112550 A1 * 6/2004 Green ..... E01F 13/022 160/135
2007/0023075 A1 * 2/2007 Nissenbaum ..... E04H 15/32 135/156

* cited by examiner

*Primary Examiner* — Winnie Yip

(57) ABSTRACT

A modular screening device includes a flexible first panel that is flexible having a vertical edge and an opposing vertical edge. A first sleeve is coupled to the vertical edge and a second sleeve coupled to the opposing vertical edge. A third sleeve is coupled to the first panel equally distant from the vertical edge and the opposing vertical edge. A first fastener is coupled to the second sleeve. A second flexible panel has a vertical border and an opposing vertical border. A first sheath is coupled to the vertical border and a second fastener is coupled to the opposing vertical border. The second fastener is complimentary to the first fastener. A second sheath is coupled to the second panel equally distant from the vertical border and the opposing vertical border. The device also comprises a plurality of framing tubes, S-hooks, spike anchors, bases, connectors, and support rods.

14 Claims, 5 Drawing Sheets

MULTIPURPOSE MODULAR SCREENING DEVICE

BACKGROUND OF THE DISCLOSURE

Field of the Disclosure

The disclosure relates to multipurpose modular screening devices and more particularly pertains to a new multipurpose modular screening device for provision of privacy, separation, and shade.

SUMMARY OF THE DISCLOSURE

An embodiment of the disclosure meets the needs presented above by generally comprising a first panel that is flexible. The first panel has a vertical edge and an opposing vertical edge, a first sleeve coupled to the vertical edge, and a second sleeve coupled to the opposing vertical edge. A third sleeve is coupled to the first panel equally distant from the vertical edge and the opposing vertical edge. A first fastener is coupled to the second sleeve. The device also comprises a second panel that is flexible. The second panel has a vertical border and an opposing vertical border. A first sheath is coupled to the vertical border, and a second fastener is coupled to the opposing vertical border. The second fastener is complimentary to the first fastener. A second sheath is coupled to the second panel equally distant from the vertical border and the opposing vertical border. The device also comprises a plurality of framing tubes, a plurality of S-hooks, a plurality of spike anchors, a plurality of bases, a plurality of connectors, and a plurality of support rods.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
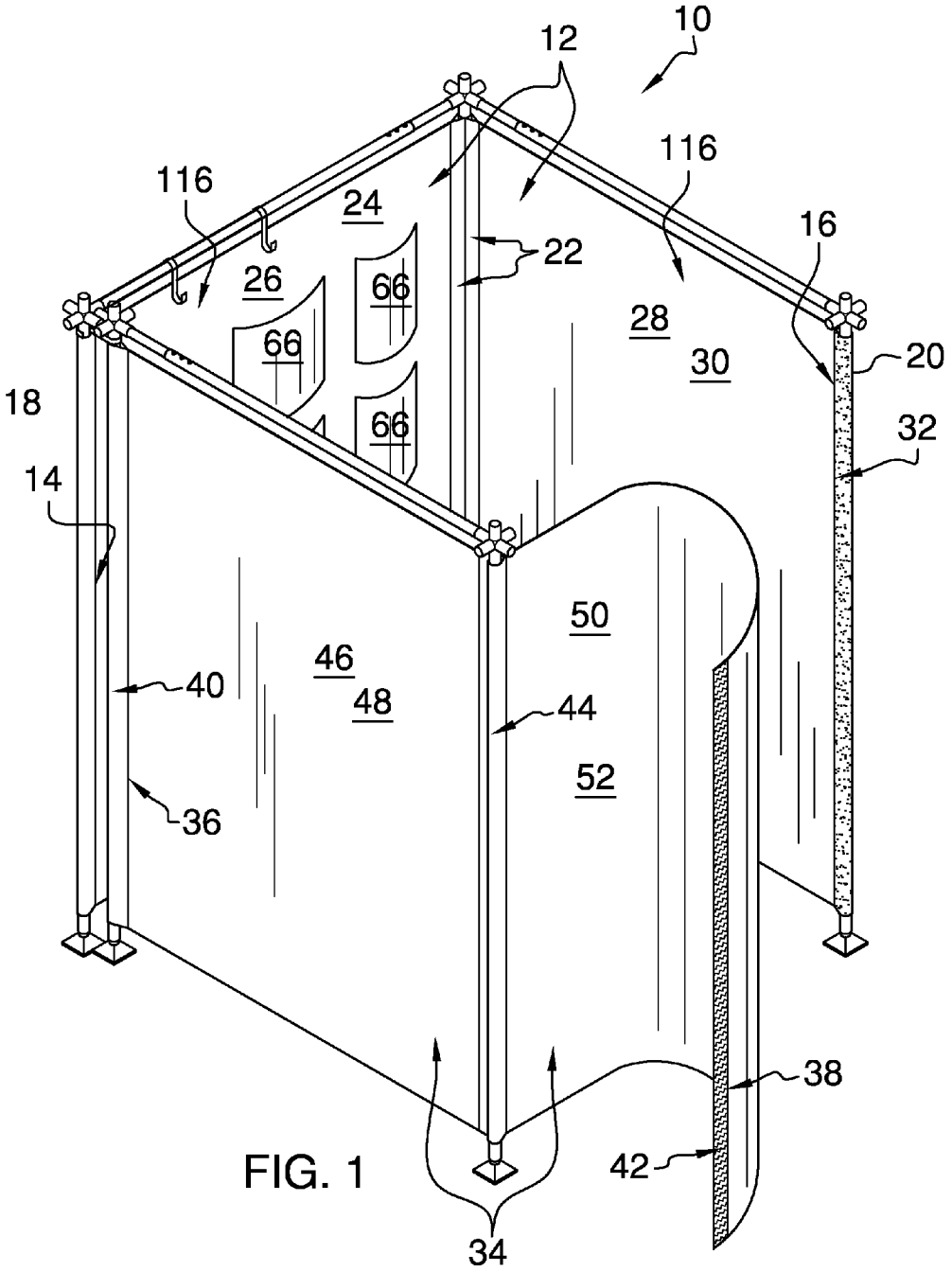
FIG. 1 is a front overhead view of a multipurpose modular screening device for provision of privacy, separation, and shade according to an embodiment of the disclosure.
Figure 2:
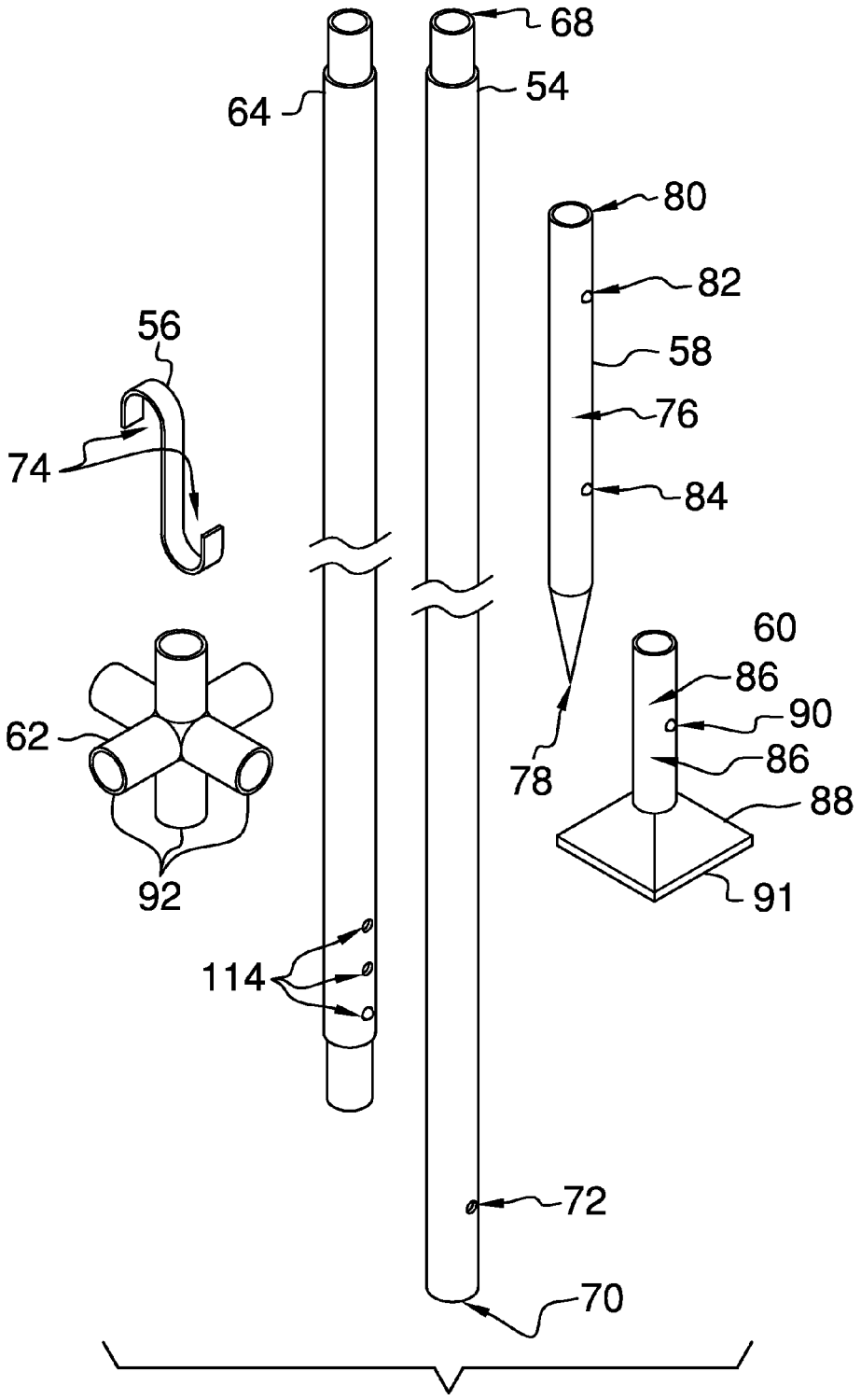
FIG. 2 is a closeup view of an embodiment of the disclosure.
Figure 3:
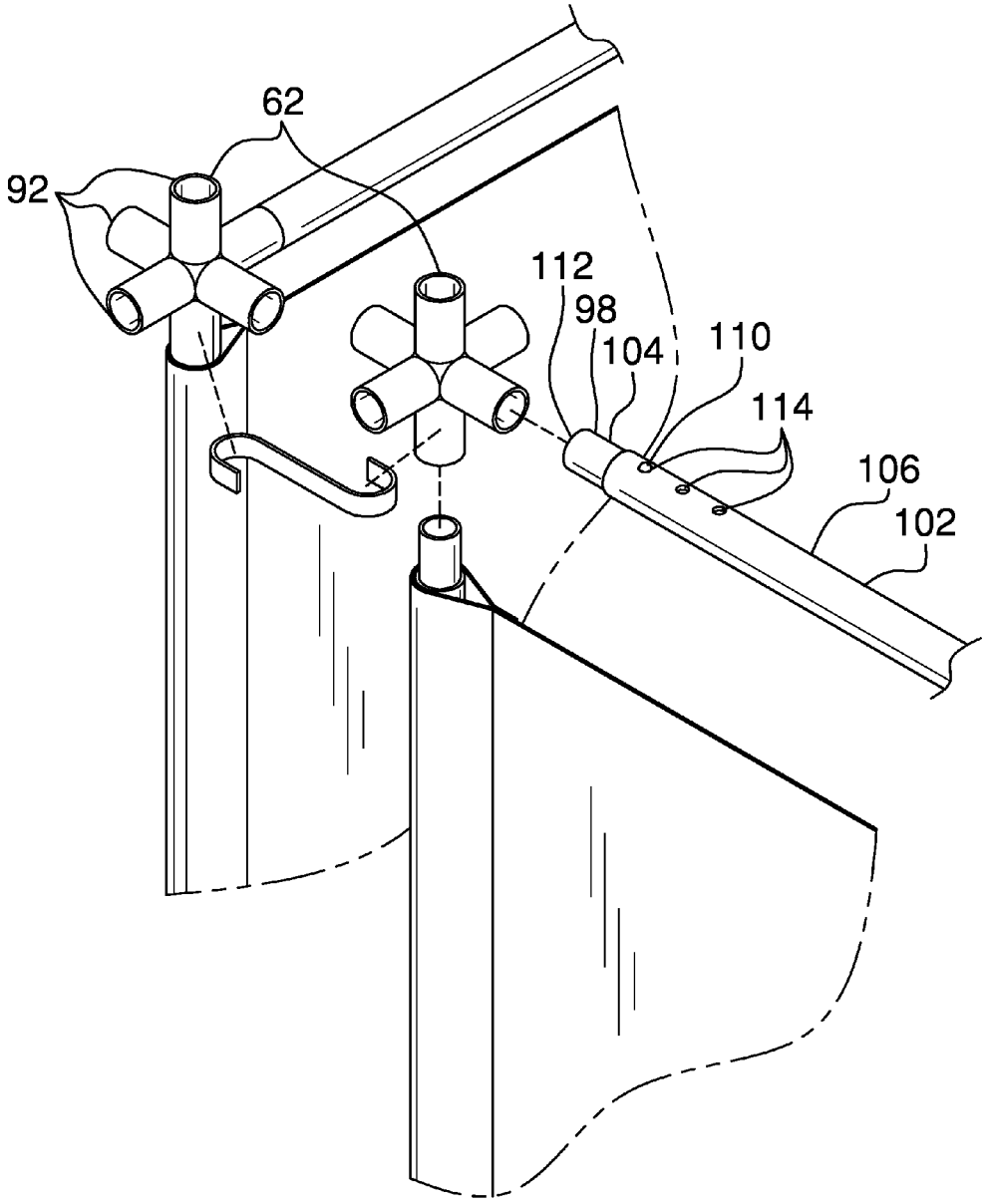
FIG. 3 is a exploded view of an embodiment of the disclosure.
Figure 4:
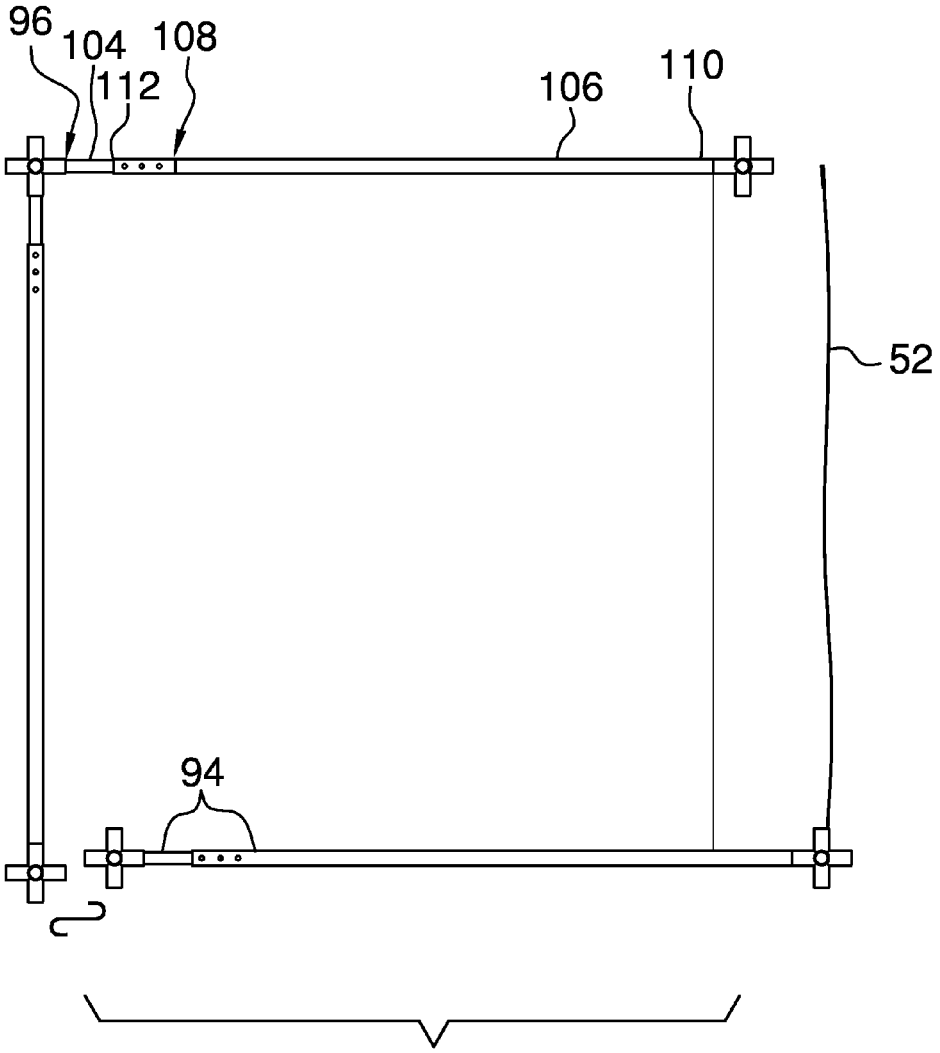
FIG. 4 is a top view of an embodiment of the disclosure.
Figure 5:
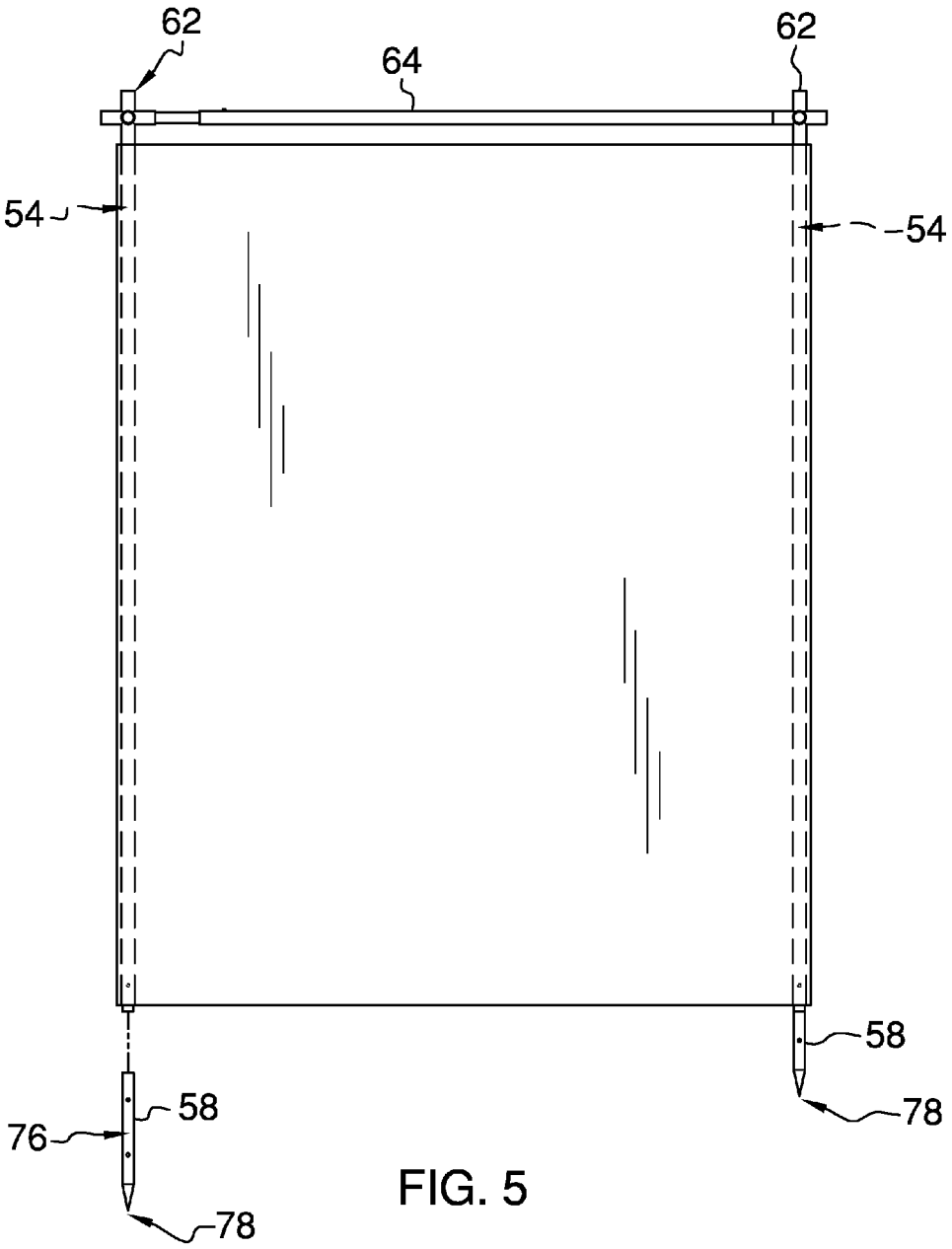
FIG. 5 is a front view of an embodiment of the disclosure.

With reference now to the drawings, and in particular to FIGS. 1 through 5 thereof, a new multipurpose modular screening device embodying the principles and concepts of an embodiment of the disclosure and generally designated by the reference numeral 10 will be described.

As best illustrated in FIGS. 1 through 5, the multipurpose modular screening device for provision of privacy, separation, and shade 10 generally comprises a first panel 12 that is flexible. The first panel 12 has a vertical edge 14 and an opposing vertical edge 16. A first sleeve 18 is coupled to the vertical edge 14 and a second sleeve 20 is coupled to the opposing vertical edge 16. A third sleeve 22 is coupled to the first panel 12 equally distant from the vertical edge 14 and the opposing vertical edge 16, such that a first field 24 between the first sleeve 18 and the third sleeve 22 comprises a first wall 26, and a second field 28 between the third sleeve 22 and the second sleeve 20 comprises a second wall 30. A first fastener 32 is coupled to the second sleeve 20. The device 10 also comprises a second panel 34 that is flexible. The second panel 34 has a vertical border 36 and an opposing vertical border 38. A first sheath 40 is coupled to the vertical border 36 and a second fastener 42 is coupled to the opposing vertical border 38. The second fastener 42 is complimentary to the first fastener 32. The first fastener 32 and the second fastener 42 may be Velcro type hook and Velcro type loop fasteners. A second sheath 44 is coupled to the second panel 34 equally distant from the vertical border 36 and the opposing vertical border 38, such that a third field 46 between the first sheath 40 and the second sheath 44 comprises a third wall 48, and a fourth field 50 between the second sheath 44 and the second fastener 42 comprises a door 52.

The device 10 also comprises a plurality of framing tubes 54, a plurality of S-hooks 56, a plurality of spike anchors 58, a plurality of bases 60, a plurality of connectors 62, a plurality of support rods 64, and a plurality of pockets 66. Each of the plurality of framing tubes 54 has a reduced top end 68, a bottom end 70, and an orifice 72 proximate to the bottom end 70. Each of the plurality of S-hooks 56 has a pair of grasping ends 74 configured to engage the plurality of framing tubes 54. Each of the plurality of spike anchors 58 has a housing 76 having a sharp end 78 and an insertable end 80. A first spring-pin 82 is coupled to the housing 76 proximate to the insertable end 80 and a second spring-pin 84 is coupled to the housing 76 proximate to the sharp end 78. The first spring-pin 82 and the second spring-pin 84 are complimentary to the orifice 72 of the framing tube 54. The spike anchor 58 is configured to engage the bottom end 70 of the of framing tube 54, such that the insertable end 80 of the spike anchor 58 can be inserted into the bottom end 70 with the first spring-pin 82 engaging the orifice 72 to lock the spike anchor 58 into the framing tube 54 with the sharp end 78 extending from the bottom 70. In an alternate configuration, the sharp end 78 of the spike anchor 54 can be inserted into the bottom end 70 with the second spring-pin 84 engaging the orifice 72 to lock the spike anchor 58 into the framing tube 54 with the insertable end 80 extending from the bottom 70. Each of the plurality of bases 60 has an upright coupler 86 coupled to a foot 88. The coupler 86 has an opening 90 that is complimentary to the first spring-pin 82 and the second spring-pin 84. The coupler 86 is configured to engage the insertable end 80 of the spike anchor 58. The foot 88 may have a square bottom 91. Each of the plurality of connectors 62 has a plurality of attachment points 92 that are configured to engage the reduced top end 68 of the framing tube 54. The plurality of attachment points 92 comprises between two and six attachment points. More preferably, the plurality of attachment points 92 comprises between four and six attachment points. Most preferably, the plurality of attachment points 92 comprises six attachment points. Each of the plurality of support rods 64 comprises a plurality of nested sections 94, such that the support rod 64 is telescopic. The support rod 64 has a first end 96 on the innermost nested section 98 and a second end 100 on the outermost nested section 102. The first end 96 and the second end 100 are configured to engage the attachment points 92. The support rod 64 may comprise an inner rod 104 and an outer rod 106. The inner rod has a first terminus 108 opposite the first end 96. Coupled to the inner rod 104 is a third spring-pin 110 proximate to the first terminus 108. The outer rod 106 has a second terminus 112 opposite the second end 100. The outer rod 106 has a plurality of holes 114 proximate to the second terminus 112. Each of the plurality of holes 114 is complimentary to the third spring-pin 110. Preferably, the plurality of holes 114 comprises three holes. Each of the plurality of pockets 66 is coupled to the first panel 14, preferably to an inner surface 116 of the first panel 14, and most preferably on the inner surface 116 of said first panel 14 between the first sleeve 18 and the third sleeve 22.

Suitable materials for construction of the plurality of framing tubes 54 and the plurality of support rods 64 include aluminum and stainless steel. Suitable profiles for the plurality of framing tubes and the plurality of support rods include a round profile and a square profile.

In use, the plurality of framing tubes 54 can be inserted one each into the first sleeve 18, the second sleeve 20, the third sleeve 22, the first sheath 40, and the second sheath 44. Structural rigidity can be effected by inserting the insertable ends 80 of the spike anchors 58 into the bottom end 70 of the framing tubes 54 and thrusting the sharp ends 78 into the ground, and by coupling the first panel 12 to the second panel 34 using the S-hooks 56. Structural rigidity also can be effected or enhanced by engaging the connectors 62 to the reduced top ends 68 of the framing tubes 54 and engaging the support rods 64 to the attachment points 92 on adjacent connectors 62. The door 52 can be closed by engaging the first fastener 32 with the second fastener 42. The first panel 12 and the second panel 34 can be reconfigured by inserting the support rods 64 into alternate attachment points 92, relocating the spike anchors 58, inverting the spike anchor 58 and attaching the base 60, placing support rods 64 into the first sheath 40 or the second sheath 44, or any combination thereof.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A multipurpose modular screening device for provision of privacy, separation, and shade, said device comprising:

a first panel, said first panel being flexible, said first panel having a vertical edge and an opposing vertical edge, a first sleeve, said first sleeve being coupled to said vertical edge, a second sleeve, said second sleeve being coupled to said opposing vertical edge, a third sleeve, said third sleeve being coupled to said first panel equally distant from said vertical edge and said opposing vertical edge, a first fastener, said first fastener being coupled to said second sleeve, a second panel, said second panel being flexible, said second panel having a vertical border and an opposing vertical border, a first sheath, said first sheath being coupled to said vertical border, a second fastener, said second fastener being coupled to said opposing vertical border, said second fastener being complimentary to said first fastener, a second sheath, said second sheath being coupled to said second panel equally distant from said vertical border and said opposing vertical border, a plurality of framing tubes, each of said plurality of framing tubes having a reduced top end, a bottom end, and an orifice proximate to said bottom end, a plurality of S-hooks, each of said S-hooks having a pair grasping ends, said pair of grasping ends being configured to engage said plurality of framing tubes, a plurality of spike anchors, each of said spike anchors having a housing, a sharp end, an insertable end, a first spring-pin coupled to said housing proximate to said insertable end and a second spring-pin coupled to said housing proximate to said sharp end, said first spring-pin and said second spring-pin being complimentary to said orifice of said framing tube, said spike anchors being configured to engage said bottom end of said of framing tube, a plurality of bases, each of said bases having an upright coupler coupled to a foot, said coupler having an opening, said opening being complimentary to said first spring-pin and said second spring-pin, said coupler being configured to engage said insertable end of said spike anchor, a plurality of connectors, each of said plurality of connectors having a plurality of attachment points, each of said plurality of attachment points being configured to engage said reduced top end of said framing tube; and a plurality of support rods, each of said plurality of support rods comprising a plurality of nested sections, wherein said support rod is telescopic, said support rod having a first end on the innermost nested section and a second end on the outermost nested section, said first end and said second end being configured to engage said attachment points, wherein a first field between said first sleeve and said third sleeve comprises a first wall, a second field between said third sleeve and said second sleeve comprises a second wall, a third field between said first sheath and said second sheath comprises a third wall, and a fourth field between said second sheath and said second fastener comprises a door, wherein said insertable end of said spike anchor can be inserted into said bottom end with said first spring-pin engaging said orifice to lock said spike anchor into said framing tube with said sharp end extending from said bottom and said sharp end of said spike anchor can be inserted into said bottom end with said second spring-pin engaging said orifice to lock said spike anchor into said framing tube with said insertable end extending from said bottom, wherein said plurality of framing tubes can be inserted one each into said first sleeve, said second sleeve, said third sleeve, said first sheath, and said second sheath, wherein structural rigidity can be effected by inserting said insertable ends of said spike anchors into said bottom end of said framing tubes and thrusting said sharp ends into the ground, wherein said spike anchor can couple said base to said framing tube when said spike anchors are not required to secure said first panel and said second panel to the ground, wherein said first panel and said second panel can be coupled using said S-hooks, wherein structural rigidity can also be effected or enhanced by engaging said connectors to said reduced top ends of said framing tubes and engaging said support rods to said attachment points on adjacently configured of said connectors, wherein said door can be closed by engaging said first fastener with said second fastener, and wherein said first panel and said second panel can be reconfigured by inserting said support rods into alternate said attachment points, relocating said spike anchors, placing said support rod into said first sheath or said second sheath, or any combination thereof.

2. The device of claim 1, further including said first fastener and said second fastener being selected from the group consisting of Velcro type hook and Velcro type loop fasteners.

3. The device of claim 1, further including said foot having a square bottom.

4. The device of claim 1, further including said plurality of attachment points comprising between two and six attachment points.

5. The device of claim 4, further including said plurality of attachment points comprising between four and six attachment points.

6. The device of claim 5, further including said plurality of attachment points comprising six attachment points.

7. The device of claim 1, further including said support rod comprising an inner rod and an outer rod, said inner rod having a first terminus opposite said first end, said inner rod having a third spring-pin coupled proximate to said first terminus, said outer rod having second terminus opposite said second end, said outer rod having a plurality of holes proximate to said second terminus, said holes being complimentary to said third spring-pin.

8. The device of claim 7, further including said a plurality of holes comprising three holes.

9. The device of claim 1, further including a plurality of pockets, said plurality of pockets being coupled to said first panel.

10. The device of claim 9, further including said plurality of pockets being coupled to an inner surface of said first panel.

11. The device of claim 10, further including said plurality of pockets being coupled to said inner surface of said first panel between said first sleeve and said third sleeve.

12. The device of claim 1, further including each of said plurality of framing tubes and each of said plurality of support rods having a profile selected from the group of profiles consisting of round and square.

13. The device of claim 1, further including each of said plurality of framing tubes and each of said plurality of support rods being constructed from the group of materials consisting of aluminum and stainless steel.

14. A multipurpose modular screening device for provision of privacy, separation, and shade, said device comprising:

a first panel, said first panel being flexible, said first panel having a vertical edge and an opposing vertical edge, a first sleeve, said first sleeve being coupled to said vertical edge, a second sleeve, said second sleeve being coupled to said opposing vertical edge, a third sleeve, said third sleeve being coupled to said first panel equally distant from said vertical edge and said opposing vertical edge, wherein a first field between said first sleeve and said third sleeve comprises a first wall, and a second field between said third sleeve and said second sleeve comprises a second wall, a first fastener, said first fastener being coupled to said second sleeve, said first fastener being selected from the group consisting of Velcro type hook and Velcro type loop fasteners, a second panel, said second panel being flexible, said second panel having a vertical border and an opposing vertical border, a first sheath, said first sheath being coupled to said vertical border, a second fastener, said second fastener being coupled to said opposing vertical border, said second fastener being complimentary to said first fastener, said second fastener being selected from the group consisting of Velcro type hook and Velcro type loop fasteners, a second sheath, said second sheath being coupled to said second panel equally distant from said vertical border and said opposing vertical border, wherein a third field between said first sheath and said second sheath comprises a third wall, and a fourth field between said second sheath and said second fastener comprises a door, a plurality of framing tubes, each of said plurality of framing tubes having a reduced top end, a bottom end, and an orifice proximate to said bottom end, a plurality of S-hooks, each of said S-hooks having a pair of grasping ends, said pair of grasping ends being configured to engage said plurality of framing tubes, a plurality of spike anchors, each of said spike anchors having a housing, a sharp end, an insertable end, a first spring-pin coupled to said housing proximate to said insertable end and a second spring-pin coupled to said housing proximate to said sharp end, said first spring-pin and said second spring-pin being complimentary to said orifice of said framing tube, said spike anchors being configured to engage said bottom end of said of framing tube, wherein said insertable end of said spike anchor can be inserted into said bottom end with said first spring-pin engaging said orifice to lock said spike anchor into said framing tube with said sharp end extending from said bottom, and said sharp end of said spike anchor can be inserted into said bottom end with said second spring-pin engaging said orifice to lock said spike anchor into said framing tube with said insertable end extending from said bottom, a plurality of bases, each of said bases having an upright coupler coupled to a foot, said coupler having an opening, said opening being complimentary to said first spring-pin and said second spring-pin, said coupler being configured to engage said insertable end of said spike anchor, said foot having a square bottom, wherein said spike anchor can couple said base to said framing tube when said spike anchors are not required to secure said first panel and said second panel to the ground, a plurality of connectors, each of said plurality of connectors having a plurality of attachment points, each of said plurality of attachment points being configured to engage said reduced top end of said framing tube, said plurality of attachment points comprising between two and six attachment points, said plurality of attachment points comprising between four and six attachment points, said plurality of attachment points comprising six attachment points, a plurality of support rods, each of said plurality of support rods comprising a plurality of nested sections, wherein said support rod is telescopic, said support rod having a first end on the innermost nested section and a second end on the outermost nested section, said first end and said second end being configured to engage said attachment points, said support rod comprising an inner rod and an outer rod, said inner rod having a first terminus opposite said first end, said inner rod having a third spring-pin coupled proximate to said first terminus, said outer rod having second terminus opposite said second end, said outer rod having a plurality of holes proximate to said second terminus, said a plurality of holes being complimentary to said third spring-pin, said a plurality of holes comprising three holes; and a plurality of pockets, said pockets being coupled to said first panel, said plurality of pockets being coupled to an inner surface of said first panel, said plurality of pockets being coupled to said inner surface of said first panel between said first sleeve and said third sleeve, wherein said plurality of framing tubes can be inserted one each into said first sleeve, said second sleeve, said third sleeve, said first sheath, and said second sheath, wherein structural rigidity can be effected by inserting said insertable ends of said spike anchors into said bottom end of said framing tubes and thrusting said sharp ends into the ground, wherein said first panel and said second panel can be coupled using said S-hooks, wherein structural rigidity can also be effected or enhanced by engaging said connectors to said reduced top ends of said framing tubes and engaging said support rods to said attachment points on adjacently configured of said connectors, wherein said door can be closed by engaging said first fastener with said second fastener, and wherein said first panel and said second panel can be reconfigured by inserting said support rods into alternate said attachment points, relocating said spike anchors inverting said spike anchors and attaching said bases, placing said support rods into said first sheath or said second sheath, or any combination thereof.

* * * * *